US006230523B1

(12) United States Patent
Apollonio

(10) Patent No.: US 6,230,523 B1
(45) Date of Patent: May 15, 2001

(54) LOOP TRANSFER NEEDLE FOR A CIRCULAR KNITTING MACHINE

(75) Inventor: Francesco Gavagnin Apollonio, 510 19th Avenue Dr., NW., Hickory, NC (US) 28601

(73) Assignee: Francesco Gavagnin Apollonio, Hickory, NC (US)

( * ) Notice: Subject to any disclaimer, the term of this patent is extended or adjusted under 35 U.S.C. 154(b) by 0 days.

(21) Appl. No.: 09/613,111

(22) Filed: Jul. 10, 2000

Related U.S. Application Data

(63) Continuation-in-part of application No. 09/241,416, filed on Feb. 2, 1999, now Pat. No. 6,085,554.

(51) Int. Cl.[7] ..... D04B 35/02

(52) U.S. Cl. ..... 66/123; 66/121; 66/116; 66/8

(58) Field of Search ..... 66/8, 13, 30, 37, 66/46, 51, 58, 95, 116, 120, 123, 215, 173, 121

(56) References Cited

U.S. PATENT DOCUMENTS

| | | | | |
|---|---|---|---|---|
| 2,060,620 | * | 11/1936 | Boaler | 66/113 |
| 2,076,896 | * | 4/1937 | Jones | 66/113 |
| 2,188,125 | * | 1/1940 | Wigley | 66/113 |
| 2,292,940 | * | 8/1942 | Holmes et al. | 66/113 |
| 2,780,082 | * | 2/1957 | Zeruneith | 66/113 |
| 2,953,914 | * | 9/1960 | Zeruneith | 66/113 |
| 2,997,865 | * | 8/1961 | Philp | 66/113 |
| 3,084,528 | * | 4/1963 | Philip | 66/113 |
| 3,110,167 | * | 11/1963 | Parthum | 66/113 |
| 3,225,569 | * | 12/1965 | Luchi | 66/120 |
| 3,470,715 | * | 10/1969 | Parthum | 66/120 |
| 3,508,420 | * | 4/1970 | Parthum et al. | 66/120 |
| 3,584,481 | * | 6/1971 | Hayashi | 66/120 |
| 3,609,998 | * | 10/1971 | Mutze et al. | 66/113 |
| 3,613,399 | * | 10/1971 | Fecker | 66/113 |
| 3,636,730 | * | 1/1972 | Fecker | 66/95 |
| 3,800,560 | * | 4/1974 | Hanney et al. | 66/14 |
| 3,838,583 | * | 10/1974 | Rumi et al. | 66/95 |
| 4,005,589 | * | 2/1977 | Uhlir | 66/95 |
| 4,612,786 | * | 9/1986 | Perotti | 66/121 |
| 6,085,554 | * | 7/2000 | Apollonio | 66/123 |
| 6,089,045 | * | 7/2000 | Apollonio | 66/13 |

FOREIGN PATENT DOCUMENTS

| | | | | |
|---|---|---|---|---|
| 446670 | * | 4/1936 | (GB) | 66/113 |
| 1246449 | * | 10/1989 | (JP) | 66/113 |

* cited by examiner

*Primary Examiner*—Danny Worrell
(74) *Attorney, Agent, or Firm*—Adams, Schwartz & Evans, P.A.

(57) ABSTRACT

An array of alternating needles and sinkers for performing a transfer stitch operation, each of said needles having an elongate shank having a hook formed on a top end thereof and a butt formed on a bottom end thereof, a latch pivotally mounted on the shank below said hook and reciprocally moveable by a yarn being formed into a loop between an open position wherein the latch resides generally alongside the shank of the needle and a closed position extending between the shank and an end of the hook, and a loop-enlarging deflector positioned on the needle shank between the latch and the butt and shaped to extend laterally into a plane defined by the hook of an immediately adjacent needle without interfering with the sinker between the needle and adjacent needle for receiving the adjacent needle through the loop whereby the loop is transferred laterally to the adjacent needle to thereby form an opening in a fabric being formed on the needles. The deflector is formed by a series of right-angle bends to efficiently and compactly form the loop.

17 Claims, 5 Drawing Sheets

LOOP TRANSFER NEEDLE FOR A CIRCULAR KNITTING MACHINE

This application is a continuation-in-part of applicant's application Ser. No. 09/241,416, filed on Feb. 2, 1999, entitled LOOP TRANSFER NEEDLE FOR A CIRCULAR KNITTING MACHINE, now U.S. Pat. No. 6,085,554, issued on Jul. 11, 2000.

TECHNICAL FIELD AND BACKGROUND OF THE INVENTION

This invention relates to needles for circular knitting machines capable of manufacturing hosiery and like articles. More particularly, the invention relates to needles useful in a stitch or loop transfer operation for creating hosiery having decorative patterns of openings formed therein.

Circular knitting machines carry out knitting operations which form multiple strands of yarn into a tubular form. Such machines can form yarn into knitted fabrics useful for many different products, dependent on, for example, the circumference of the machine cylinder, the gauge and size of needles. One typical application is the production of hosiery, such as socks, hose and stockings. Such machines include a plurality of needles positioned in axial slots formed in an exterior surface of a rotatable needle cylinder. A plurality of sinkers are mounted between the needles to hold the knitted loops. A feeder mechanism delivers yam onto the passing needles in succession. The yarn forms loops over each needle in a controlled manner.

Patterns of open areas in circular knitted fabric formed by dropping stitches in a controlled manner. Heretofore, the formation of open-work pattern designs has been limited to relatively coarse gauge machines because of the difficulty in transferring a loop from one needle an adjacent needle to thus form the opening in a controlled, reliable manner on fine gauge hosiery machines.

In other applications, transfer of the stitch may be accomplished to prevent running or "laddering" of hosiery products.

In the particular embodiment shown in this application for purposes of illustration, the knitting machine is a circular knitting machine of the type used for knitting hosiery. In this type of machine, the garment, as knitted, is held under tension in the throat of the cylinder. The pattern may be controlled by any type of patterning device, such as known electronic, electro-mechanical or mechanical devices.

Any type of knitting machine may be modified according to the general principles of this application, provided the stitches are otherwise capable of being transferred from one needle to another.

Creation of patterns in knitted articles by transferring stitches from one needle to another is known in the prior art. In one prior art knitting machine, the knitting needles of the machine are separated by transfer members which reside in and move in the same vertical plane as the knitting needles and therefore separate the needles at all times. This limits the gauge of the fabrics which can be knitted with this type of machine since the diameter of the machine must accommodate both the knitting needles and the transfer members. For this reason, it has heretofore been impractical to knit fine hosiery with intricate, decorative patterns formed by transferring stitches.

Another prior art device uses a dial plate eccentric with respect to the needle cylinder and defines with the needle cylinder an enlarged loop transfer zone. The dial plate includes horizontally-disposed punches which facilitate transfer of loops from the certain needles of the needle cylinder onto adjacent needles.

A transfer stitch operation involves transferring a stitch from a selected needle to a following needle. As used herein, a selected needle is a needle from which the transfer stitch is removed, and a following needle is an adjacent needle to which the transfer stitch is placed. To perform the transfer stitch operation, the stitch on the selected needle is enlarged or widened. Once the stitch on the selected needle is sufficiently enlarged, the following needle is inserted through the enlarged stitch such that the stitch can then be secured around the following needle. Finally, the selected needle is removed from the enlarged stitch thereby causing the selected needle to release the stitch. As a result, the stitch is completely transferred from the selected needle to the following needle and a controlled perforation is formed in the hosiery article being created. A pattern of perforations can be formed in the hosiery article by selecting needles in accordance with a pre-determined set of instructions.

Prior art devices transfer the stitch from one needle to another needle by first removing the stitch from one needle and then placing it onto the adjacent needle. This practice increases the likelihood of missed transfers and other defects in the finished product.

Because the stitches on a selected needle must be enlarged before they are transferred to an adjacent needle, a considerable amount of tension is exerted on the yarn. As a result, it is quite possible that the yarn will break during the transfer stitch operation. A broken yarn, like a run, makes the article being formed unusable. There exists a need for a needle that minimizes the tension on the yarn during the transfer stitch operation necessary to form decorative open-work in hosiery and other knitted products.

Another impediment to performing the transfer stitch operation is the limited space between and around needles. This problem is also accentuated by the presence of the sinkers between the needles which affect the orientation and size of the opening created when the stitches are enlarged. In addition to the need to minimize the tension on the yarn, the lack of space available between and around the needles greatly reduces the extent to which the stitches can be enlarged. As a result of these limitations to enlarging a selected stitch, adjacent needles entering an enlarged stitch have little room for error lest the adjacent needle not enter the enlarged stitch. This results in the stitch being dropped and a run being formed in the hosiery article being created.

SUMMARY OF THE INVENTION

Therefore, it is an object of the invention to provide a needle capable of performing the transfer stitch operation by properly positioning the enlarged stitch with respect to the following needle to ensure error free transfers.

It is another object to provide a way of transferring a knitting stitch or loop from one needle to another needle in a controlled manner by placing the stitch on the new needle before removing it from the old one.

A further and more particular object of the invention is to provide a needle for virtually error-free transferring of a stitch from a selected needle to a following needle on a circular knitting machine operating 120 needles or more mounted in a needle cylinder having a diameter of 3.5 inches or less.

Another object of the invention is to provide a needle having means for reducing the tension on the yarn when the stitch is enlarged.

Another object of the invention is to provide a needle having means for preventing the stitch from traveling down below the deflector of the selected needle.

Another object of the invention is to provide a needle having means for favoring the entry of the following needle through the enlarged stitch on a selected needle.

The present invention is a circular knitting machine needle capable of performing virtually error-free transfer stitches to create hosiery articles having a pattern of small perforations. The needle according to the invention includes an elongate shank having opposed top and bottom ends. A hook is formed in a top end of each needle shank and a butt is formed in a bottom end of each needle shank. Each needle preferably has a latch mounted on the needle shank below the hook. The latch pivots between a hook closed position in which the distal end of the latch abuts the distal end of the hook and a hook open position in which the latch abuts the shank of the needle and is distally disposed with respect to the hook. When a needle is positioned in the axial groove of a needle cylinder, the hook and latch of each needle are aligned in a radially outwardly manner with respect to the needle cylinder, and the butts formed in the bottom end of each needle extend radially outwardly beyond the circumference of the needle cylinder.

The needle includes a stitch-enlarging means positioned on the needle shank at a point below the latch. In a preferred embodiment, the stitch-enlarging means is a deflector integrally formed with and extending laterally from the needle shank at a location below the latch. The deflectors are generally delta shaped, sharing a common edge with the needle shank and increasing in width from top to bottom. The distal region of each deflector extends beyond the plane of the shank of an adjacent needle. Finally, the deflectors initially extend radially outwardly, but they then curve radially inwardly toward the longitudinal axis of the needle cylinder.

During the stitch transfer operation, the selected needle rises upwardly causing the stitch on that needle to slide down the needle shank. The stitch eventually encounters the deflector. As the stitch slides down the sloping edge of the deflector, the stitch is enlarged.

In accordance with the present invention, means for retaining a stitch, such as a catch, is preferably formed in the distal region of each deflector. The stitch-retaining means limits downward movement of an enlarged stitch to prevent the stitch from moving down below the deflector. When the stitch is caught by the stitch-retaining means, the stitch is enlarged beyond the plane of the following needle. Also, a recess is preferably formed in the shank of the needle proximate to the deflector. The recess reduces the tension on the yam by reducing the size of the enlarged stitch. The recess preferably has a semi-circular shape having an apex in alignment with the stitch-retaining means.

Finally, an extension is formed in the top surface of the hook to facilitate entry of the following needle through the stitch enlarged be the deflector on the selected needle. The extension is preferably pointed and slanted in the direction of the enlarged stitch. Consequently, the probability that the following needle will miss entering an enlarged stitch is significantly reduced.

It is contemplated by the present invention that the needles may have either a left-hand or a right-hand orientation. Therefore, a stitch can be transferred from a selected needle to a following needle immediately preceding the selected needle with respect to the direction of needle cylinder rotation or a stitch can be transferred from a selected needle to a following needle immediately succeeding needle with respect to the direction of needle cylinder rotation.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
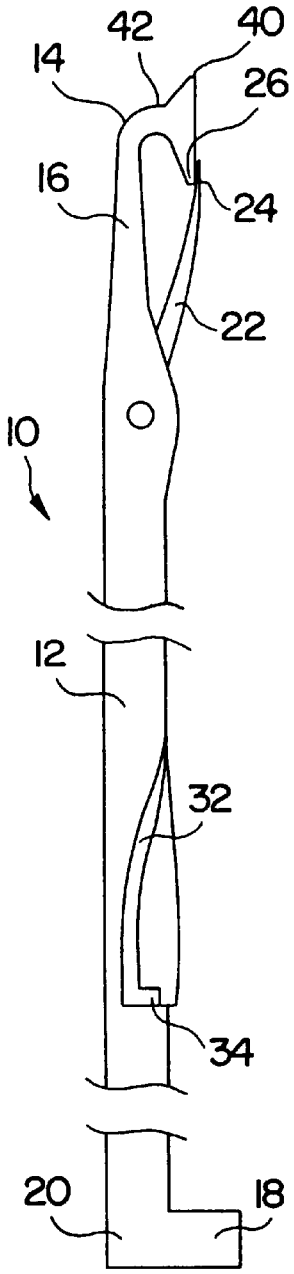
FIG. 1 is a side view of a circular knitting machine needle according to an embodiment of the invention.
Figure 2:
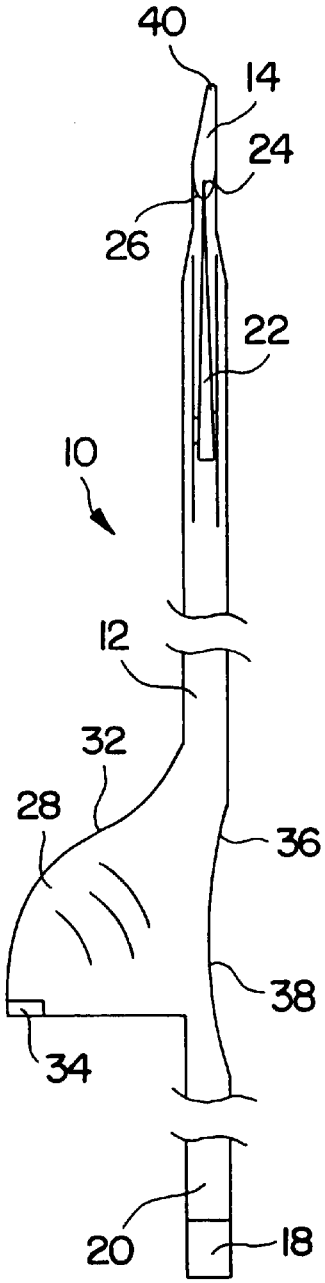
FIG. 2 is a front view of the needle of FIG. 1.
Figure 3:
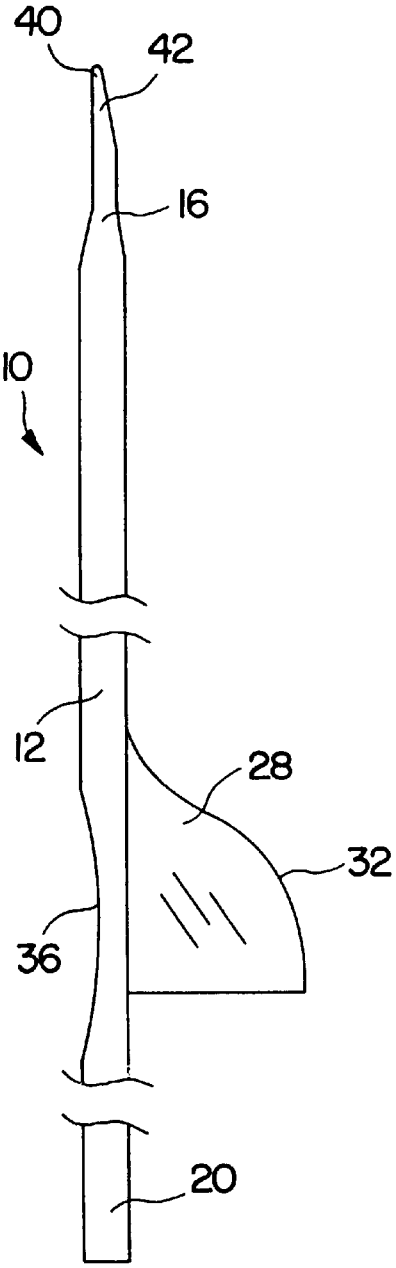
FIG. 3 is a rear view of the needle of FIG. 1.
Figure 4:
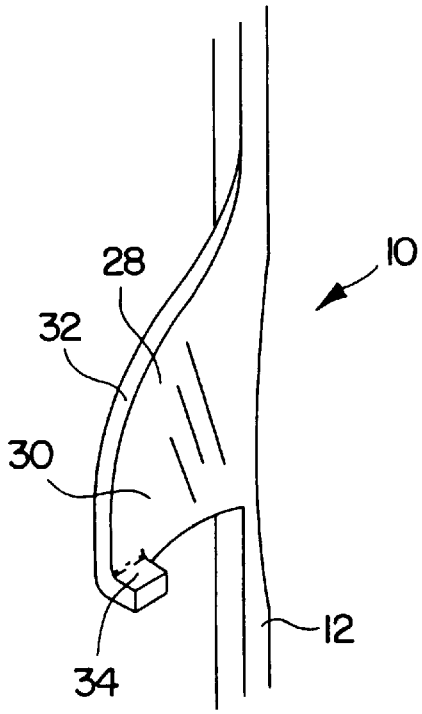
FIG. 4 is a close-up view of a preferred deflector having stitch-retaining means.
Figure 5:
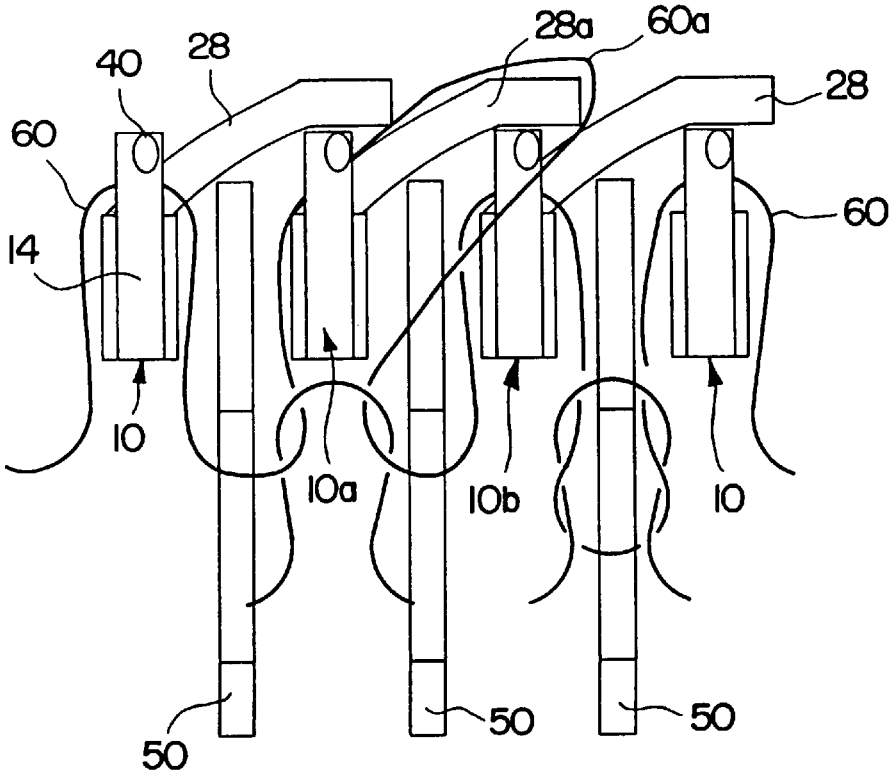
FIG. 5 is a top view of several needles and sinkers.

Referring now specifically to the drawings, a knitting needle according to the present invention is illustrated in FIGS. 1, 2 and 3 and shown generally at reference numeral 10. A plurality of needles 10 are mountable in axial grooves formed in an exterior surface of a hollow needle cylinder (not shown). The needles 10 are equidistantly spaced in a circular pattern around the circumference of the needle cylinder. As shown in FIG. 5, sinkers 50 are alternately positioned between the needles.

Each needle 10 includes an elongate shank 12 having opposed top and bottom ends. A hook 14 is formed in the top end 16 of the needle shank 12, and a butt 18 is formed in the bottom end 20 of the needle shank 12. Below the hook 14, a latch 22, pivotally attached to the needle shank 12, opens and closes the hook 14. The latch 22 pivots between a hook closed position in which the distal end 24 of the latch 22 abuts the distal end 26 of the hook 14 and a hook open position in which the latch 22 abuts the needle shank 12 and is distally disposed with respect to the hook 14. In the closed position, a knitted loop is permitted to be released by sliding over the top of the hook 14 of the needle 10. In the open position, the yarn is caught by the hook 14 in order to form loop and pull it through a previously-formed loop, thus making a stitch.

As is commonly the case, the hook 14 and latch 22 are radially aligned with respect to the needle cylinder. As shown in FIGS. 1–4, a loop deflector 28 is integrally formed with and extends laterally outwardly from the needle shank 12 at a point below the latch 22. The deflectors 28 are generally delta shaped, having a smooth, progressively-increasing dimension as it extends towards the butt 18. Deflector 28 share a common edge with the needle shank 12. As shown in FIG. 5, a distal region 30 of each deflector 28 extends beyond the plane of the shank of an adjacent needle 10. The deflectors 28 initially extend radially outwardly, but then curve radially inwardly toward the center of the needle cylinder.

The needles 10 form knitting stitches from yarns in a cycle that begins in a feeder zone where a feeder mechanism (not shown), drawing from multiple spools (not shown), continuously delivers yarn onto each needle 10. Initially, the latches 22 on the needles 10 are in the hook open position such that the strands of yarn form loops or stitches 60 around the hooks 14 of the needles 10. The stitches 60 are held in position by the sinkers 50. The latches 22 are then moved to the hook closed position in a conventional manner by cams, thereby securing the stitches 60 in the hooks 14. Stitch transfer takes place where stitches 60*a* on selected needles 10*a* are transferred to following needles 10*b*.

During the stitch transfer operation, the selected needle 10*a* is raised upwardly by a cam, causing the stitch 60*a* on that needle 10*a* to slide down the needle shank 12. The stitch 60*a* eventually encounters the deflector 28*a*. As the stitch 60*a* slides down the sloping edge 32 of the deflector 28, the stitch 60*a* is enlarged in a lateral dimension over into an area in the plane of the adjacent needle 10*b*.

As shown in FIGS. 1–4, a catch 34 is formed in the distal region 30 of each deflector 28. The catch 34 limits downward movement of an enlarged stitch 60*a* to prevent the stitch 60*a* from moving down below the deflector 28 and onto the shank 12 of the needle 10. When the stitch 60*a* is held by the catch 34, the stitch 60*a* is enlarged beyond the plane of the shank 12 of the following needle 10*b*, as shown in FIG. 5.

A concave recess 36 is preferably formed in the shank 12 of the needle 10 opposite to the deflector 28. The recess 36 reduces the tension on the yarn reducing the amount of yarn to form the enlarged stitch 60A and thus reducing the size of an enlarged stitch 60*a*. The recess 36 preferably arcuate in shape.

The needle 10 includes an extension 40 formed in the top surface 42 of the needle hook 14. The extension 40 facilitates the entry of the following needle 10*a* by reducing the profile of the needle 10 which must fit through the enlarged loop.

Figure 6:
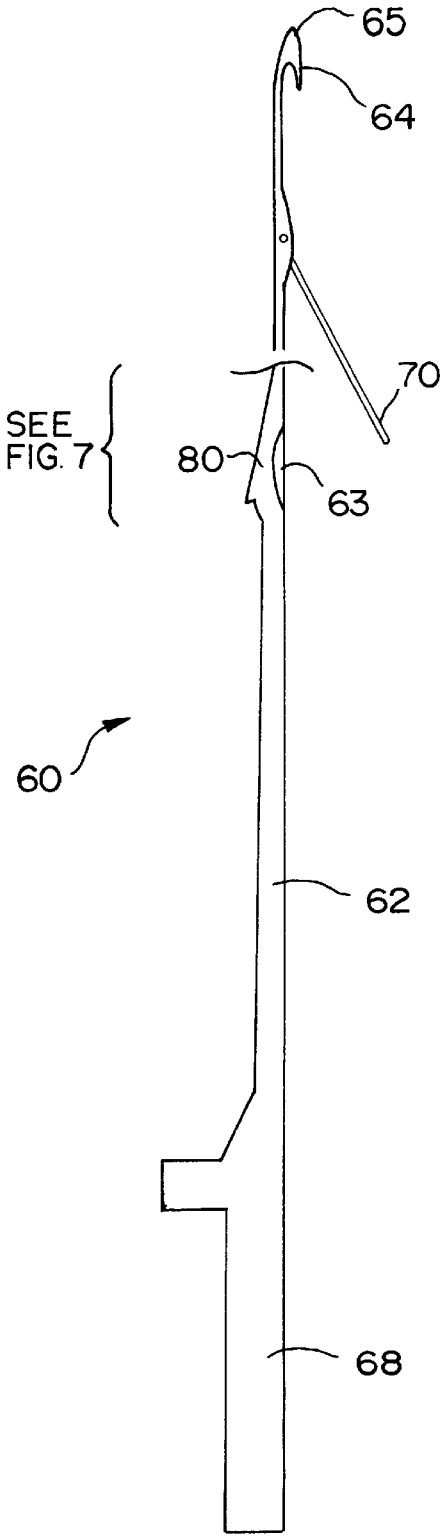
FIG. 6 is a side view of a circular knitting machine needle according to a further preferred embodiment of the invention.
Figure 7:
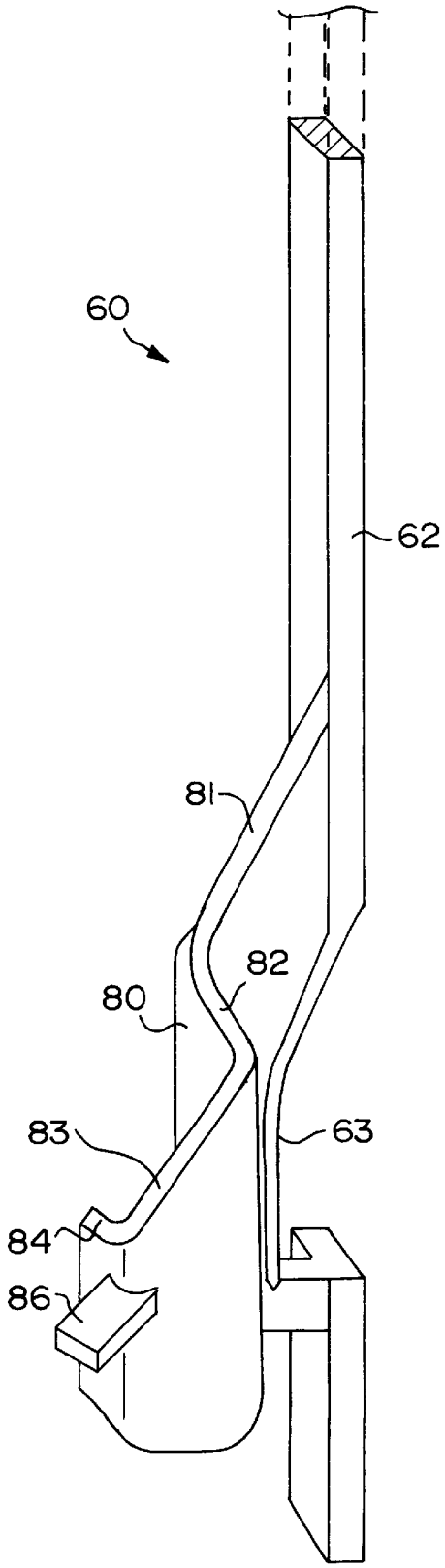
FIG. 7 is a fragmentary perspective view of the needle shown in FIG. 6.
Figure 8:
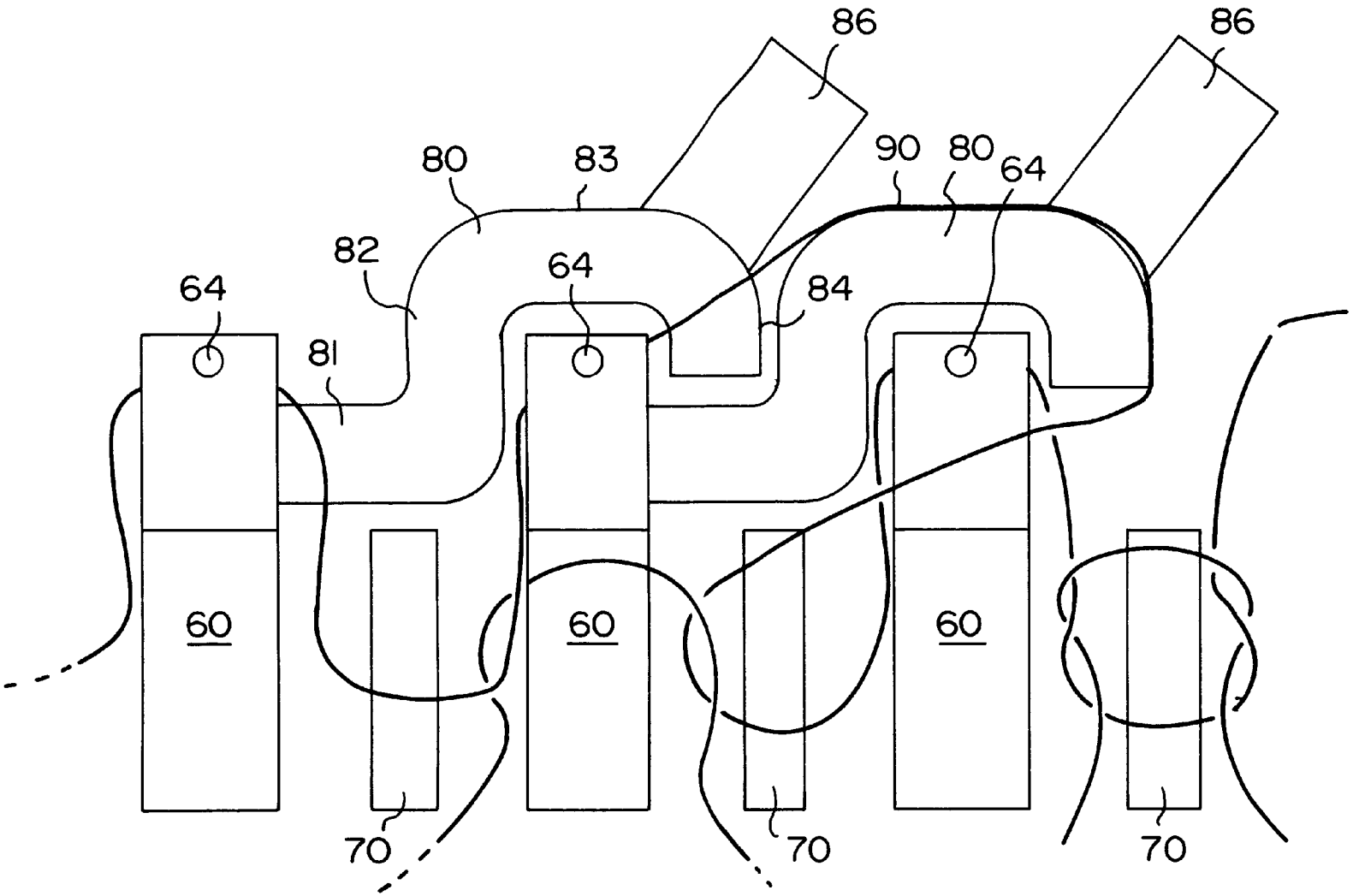
FIG. 8 is a top schematic view of several needles and sinkers using the needle shown in FIG. 6.
Figure 9:
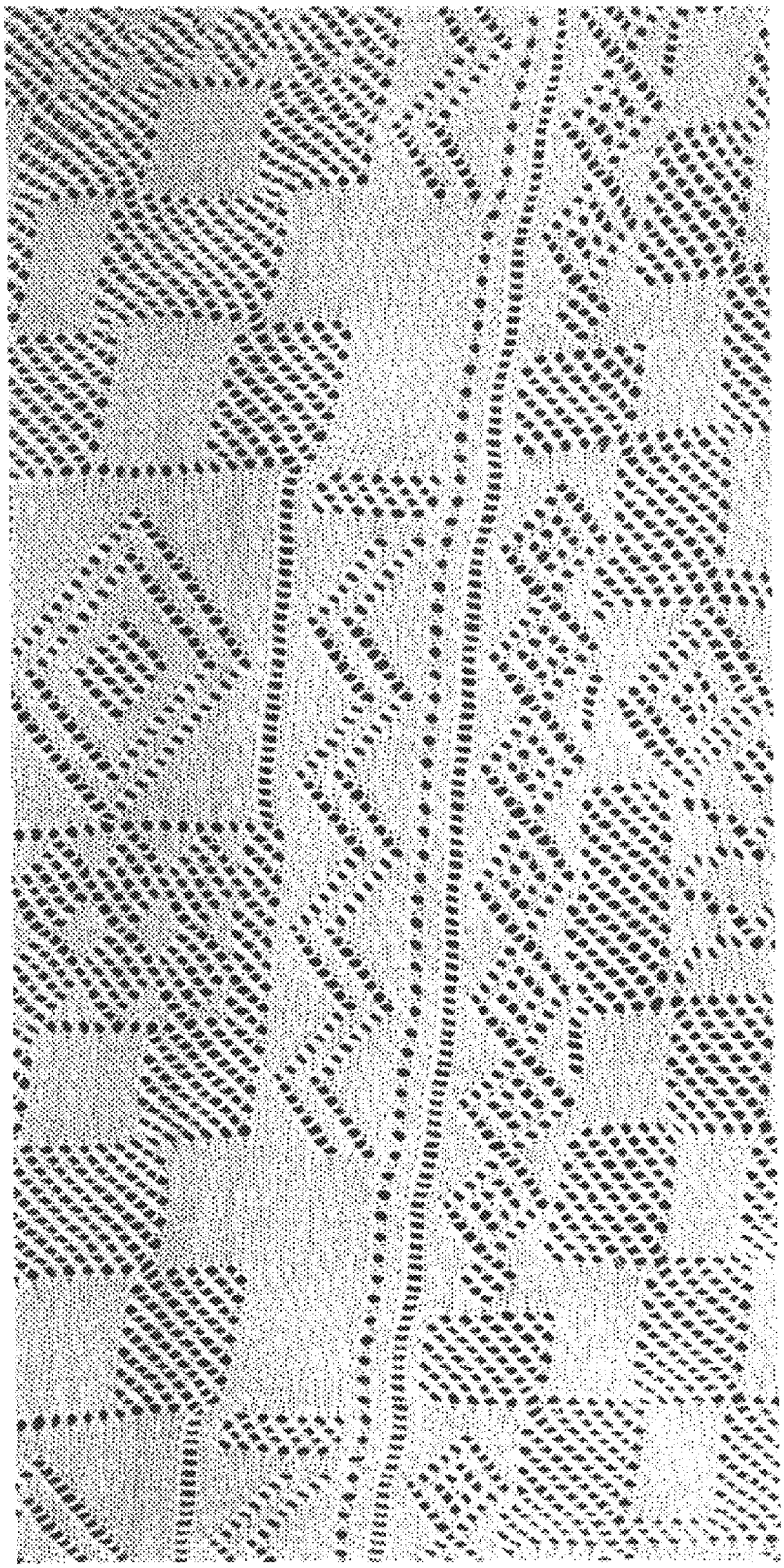
FIG. 9 is a fabric knitted using needles of the type illustrated in FIGS. 1 and 6.

Referring now to FIGS. 6–9, a knitting needle according to a preferred embodiment of the present invention is illustrated in FIGS. 6 and 7, and shown generally at reference numeral 60. A plurality of needles 60 are mountable in axial grooves formed in an exterior surface of a hollow needle cylinder (not shown). The needles 60 are equidistantly spaced in a circular pattern around the circumference of the needle cylinder. As shown in FIG. 8, sinkers 70 are alternately positioned between the needles.

Each needle 60 includes an elongate shank 62 having opposed top and bottom ends. A hook 64 is formed in the top end of the needle shank 62, and a butt 68 is formed in the bottom end of the needle shank 62. Below the hook 64, a latch 70 is pivotally attached to the needle shank 62, and opens and closes the hook 64 as it pivots between the open position shown in FIG. 6 and a closed position (not shown) where the latch 70 engages the free end of the hook 64. In the closed position, a knitted loop is permitted to be released by sliding over the top of the hook 64 of the needle 60. In the open position, the yarn is caught by the hook 64 in order to form loop and pull it through a previously-formed loop, thus making a stitch.

The hook 14 and latch 22 are radially aligned with respect to the needle cylinder, and in this respect the arrangement described is completely conventional. As shown in FIGS. 6, 7 and 8, a loop deflector 80 is positioned on and extends laterally outwardly from the needle shank 62 at a point below the latch 70. Each deflector 80 is generally delta shaped, having a smooth, progressively-increasing dimension as it extends towards the butt 68. Each deflector 80 shares a common edge with the needle shank 62. As shown in FIG. 8, a distal region of each deflector 80 extends beyond the plane of the shank of an adjacent needle 60. The deflectors 80 have four distinct right-angle segments 81, 82, 83 and 84 which collectively form the increasing dimension as they extend downwardly towards the needle butt 68. These segments 81, 82, 83 and 84 precisely extend around the plane of the adjacent sinker 60 without interference with the sinker 60, and interlock around the immediately adjacent hook 60. It has been found that this shape provides a precisely repeating, relatively open and elongated loop which will be transferred to the immediately adjacent needle 60 in a highly reliable manner. The arrangement is nevertheless very compact.

The needles 60 form knitting stitches from yams in a cycle that begins in a feeder zone where a feeder mechanism (not shown), drawing from multiple spools (not shown), continuously delivers yam onto each needle 60. Initially, the latches 70 on the needles 60 are in the hook open position such that the strands of yam form loops or stitches 90 around the hooks 64 of the needles 60. The stitches 90 are held in position by the sinkers 70. The latches 70 are then moved to the hook closed position in a conventional manner by cams, thereby securing the stitches 90 in the hooks 64.

During the stitch transfer operation, the selected needle 60 is raised upwardly by a cam, causing the stitch 90 on that needle 60 to slide down the needle shank 62. The stitch 90 eventually encounters deflector 80. As the stitch 90 slides down the sloping edge of the deflector 80, the stitch 60 is enlarged in a lateral dimension over into an area in the plane of the adjacent needle 60, as shown in FIG. 8.

As shown in FIGS. 6–8, a catch 86 is formed in the distal region of each deflector 80. The catch 86 limits downward movement of an enlarged stitch 90 to prevent the stitch 90 from moving downwardly off of the deflector 80 and onto the shank 92 of the needle 60. At the point where the stitch 90 is held by the catch 86, the stitch 90 is enlarged beyond the plane of the shank 62 of the immediately adjacent needle 62, as shown in FIG. 8.

A concave recess 63 is preferably formed in the shank 62 of the needle 60 opposite to the deflector 80. The recess 63 reduces the tension on the yarn and reduces the amount of yarn needed to form the enlarged stitch 90 and thus reducing the size of an enlarged stitch 90. The recess 63 preferably arcuate in shape.

The needle 60 includes an extension 65 formed on the top of the hook 64 of the needle 60. The extension 64 facilitates the entry of the immediately adjacent needle 60 by reducing the initial profile of the needle 60 which must fit through the enlarged loop.

A fabric of the type which can be formed using the invention according to the disclosure and claims is shown in FIG. 8.

A knitting needle is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a circular knitting machine for knitting complex transfer stitch patterns in fine gauge yarns, the combination therewith of an array of alternating needles and sinkers for performing a transfer stitch operation, each of said needles comprising:

(a) an elongate shank having a hook formed on a top end thereof and a butt formed on a bottom end thereof;

(b) a latch pivotally mounted on the shank below said hook and reciprocally moveable by a yarn being formed into a loop between an open position wherein the latch resides generally alongside the shank of the needle and a closed position extending between the shank and an end of the hook; and (c) loop-enlarging means positioned on the needle shank between the latch and the butt and shaped to extend laterally into a plane defined by the hook of an immediately adjacent needle without interfering with the sinker between the needle and adjacent needle for receiving the adjacent needle through the loop whereby the loop is transferred laterally to the adjacent needle to thereby form an opening in a fabric being formed on the needles.

2. In a knitting machines according to claim 1, wherein said loop-enlarging means comprises a loop deflector having a progressively increasing laterally-extending dimension towards the butt end of the needle for enlarging the loop as the needle moves upwardly relative to the loop.

3. In a knitting machine according to claim 2, and including loop retaining means formed on a distal portion of said deflector for retaining the loop on the deflector during loop transfer.

4. In a knitting machine according to claim 1, and including a recess formed in the shank of the needle in opposing alignment with the loop-enlarging means for reducing the amount of yarn needed to form the enlarged loop.

5. In a knitting machine according to claim 1, and including an extension formed on the hook, said hook having a reduced profile and extending upwardly from the hook for penetrating the loop formed for transfer.

6. In a knitting machine according to claim 5, wherein said extension has a pointed upper projection.

7. In a knitting machine according to claim 5, wherein said extension extends obliquely out of the plane of the shank towards an adjacent needle.

8. In a knitting machine according to claim 1, wherein said cylinder has at least 120 needles and a diameter of 3.5 inches or less.

9. A knitting needle for being formed into an array of alternating needles and sinkers for performing a transfer stitch operation, said needle comprising:

(a) an elongate shank having a hook formed on a top end thereof and a butt formed on a bottom end thereof;

(b) a latch pivotally mounted on the shank below said hook and reciprocally moveable by a yarn being formed into a loop between an open position wherein the latch resides generally alongside the shank of the needle and a closed position extending between the shank and an end of the hook; and (c) loop-enlarging means positioned on the needle shank between the latch and the butt and shaped to extend laterally into a plane defined by the hook of an immediately adjacent needle without interfering with the sinker between the needle and adjacent needle for receiving the adjacent needle through the loop whereby the loop is transferred laterally to the adjacent needle to thereby form an opening in a fabric being formed on the needles.

10. In a circular knitting machine for knitting complex transfer stitch patterns in fine gauge yarns, the combination therewith of an array of alternating needles and sinkers for performing a transfer stitch operation, each of said needles comprising:

(a) an elongate shank having a hook formed on a top end thereof and a butt formed on a bottom end thereof;

(b) a latch pivotally mounted on the shank below said hook and reciprocally moveable by a yarn being formed into a loop between an open position wherein the latch resides generally alongside the shank of the needle and a closed position extending between the shank and an end of the hook; and (c) loop-enlarging means positioned on the needle shank between the latch and the butt and shaped to extend progressively laterally into a plane defined by the hook of an immediately adjacent needle without interfering with the sinker between the needle and adjacent needle for receiving the adjacent needle through the loop whereby the loop is transferred laterally to the adjacent needle to thereby form an opening in a fabric being formed on the needles, said loop-enlarging means comprising:

(1) a first segment extending outwardly from a side of the shank at substantially right angles thereto across the plane of and forwardly of the adjacent sinker and towards the immediately adjacent needle;

(2) a second segment extending outwardly from the first segment at a substantially right angle to the first segment and parallel to the side of the shank of the needle;

(3) a third segment extending outwardly from the second segment at a substantially right angle thereto and into a loop-forming position adjacent the hook of the immediately adjacent needle; and (4) a fourth segment extending outwardly from the third segment at a substantially right angle to the third segment and parallel to the side of the shank of the immediately adjacent needle in close proximity to the side of the immediately adjacent needle remote from said needle;

whereby a loop formed by said needle which is relatively open in relation to its length for being positioned over the immediately-adjacent needle may be transferred laterally to the immediately adjacent needle without interfering with the intermediate sinker.

11. In a knitting machines according to claim 10, wherein said loop-enlarging means comprises a loop deflector having a progressively increasing laterally-extending dimension towards the butt end of the needle for enlarging the loop as the needle moves upwardly relative to the loop.

12. In a knitting machine according to claim 11, and including loop retaining means formed on a distal portion of said deflector for retaining the loop on the deflector during loop transfer.

13. In a knitting machine according to claim 10, and including a recess formed in the shank of the needle in opposing alignment with the loop-enlarging means for reducing the amount of yarn needed to form the enlarged loop.

14. In a knitting machine according to claim 12, wherein said loop-retaining means comprises an extension extending outwardly from the loop-enlarging means.

15. In a knitting machine according to claim 10, wherein said needle includes an elongated point extending upwardly from the top of the hook.

16. In a knitting machine according to claim 14, wherein said extension extends obliquely out of the plane of the shank towards an adjacent needle.

17. In a knitting machine according to claim 10, wherein said cylinder has at least 120 needles and a diameter of 3.5 inches or less.

* * * * *